US005184412A

United States Patent [19]

Kopinski et al.

[11] Patent Number: 5,184,412

[45] Date of Patent: Feb. 9, 1993

[54] AUGER TOOTH LOCKING MECHANISM

[75] Inventors: Martin W. Kopinski, Tracy; George J. Bogdanich, San Jose, both of Calif.

[73] Assignee: Pengo Corporation, Union City, Calif.

[21] Appl. No.: 896,278

[22] Filed: Jun. 10, 1992

[51] Int. Cl.[5] ..... E02F 9/28

[52] U.S. Cl. ..... 37/142 A; 37/141 T

[58] Field of Search ..... 37/142 R, 141 T, 142 R, 37/142 A; 411/514; 172/713, 751, 772.5

[56] References Cited

U.S. PATENT DOCUMENTS

| | | | |
|---|---|---|---|
| 2,968,880 | 1/1961 | Petersen | 37/142 A |
| 3,057,091 | 10/1962 | Petersen | 37/142 A |
| 3,152,412 | 10/1964 | Benetti | 37/191 |
| 3,323,236 | 6/1967 | Petersen | 37/142 A |
| 3,349,508 | 10/1967 | Petersen | 37/142 A |
| 3,400,476 | 9/1968 | Petersen | 37/142 A |
| 3,496,657 | 2/1970 | Sturgeon | 37/142 A |
| 3,526,435 | 9/1970 | Krekeler | 37/142 A |
| 4,261,118 | 4/1981 | Boemer | 37/142 A |
| 5,047,062 | 12/1991 | Hahn et al. | 37/141 T |

*Primary Examiner*—Randolph A. Reese
*Assistant Examiner*—Arlen L. Olsen
*Attorney, Agent, or Firm*—Townsend and Townsend

[57] ABSTRACT

An elongated resilient retainer is positioned between an excavating tooth and tooth holder such that the tooth and tooth holder compress and, thus, deform the retainer to frictionally secure the tooth to the tooth holder. The resilient retainer includes ribs that extend longitudinally along its outer surface. These ribs are circumferentially spaced such that when the retainer is under compression, the ribs engage and grip the upper and lower edges of the tooth adjacent thereto. In this way, the area of surface contact between the resilient retainer and the surface between which it is compressed is augmented to more securely hold the tooth in the tooth holder.

14 Claims, 2 Drawing Sheets

AUGER TOOTH LOCKING MECHANISM

BACKGROUND OF THE INVENTION

The present invention relates to an excavating tooth assembly generally, and more particularly to an assembly that includes a resilient member for securing an excavating tooth in a holder.

U.S. Pat. Nos. 2,968,880 and 3,323,236 to Peterson disclose excavating tooth assemblies including a tooth having a tapered distal end for digging and a proximal end having laterally spaced prongs which are secured in a recess of a shank or tooth holder by a resilient retainer. The resilient retainer is generally positioned between the tooth prongs and portions of the tooth holder that are adjacent to the prongs to frictionally secure the tooth in the tooth holder. In U.S. Pat. No. 2,968,880, an excavating tooth formed with two laterally spaced prongs is received in a recess formed in a tooth holder. A web, extending vertically in the recess, fits in the space formed between the two prongs. Before the prongs are positioned about the web, a resilient retainer (preferably circular in cross-section) is passed through a transverse hole in the web to be pushed backwardly and against the outer walls of the web as the tooth prongs are inserted into the tooth holder. In this manner, the resilient retainer is compressed between the vertical outer walls of the web and the inner vertical surfaces of the tooth prongs to secure the tooth to the tooth holder.

In U.S. Pat. No. 3,323,236, the resilient member is located and positioned in a different manner to enhance the area of surface contact between the resilient retainer and the surfaces between which it is compressed to more securely hold the tooth in the holder. The holder includes top and bottom flanges between which the tooth prongs are inserted. Before the prongs are inserted into the tooth holder, the resilient member is bent in a U-shape and the ends thereof inserted into a pair of downwardly-rearwardly directed holes formed through either the top or bottom flange. When the tooth is forced into the recess formed between the spaced top and bottom flanges of the holder, the internal ends of the resilient retainer are compressed between the prongs and the inner surface of the flange through which the retainer extends to secure the tooth to the holder. In one embodiment, grooves are provided in the inner surface of the flange to receive the retainer ends. The cross-sectional shape of each groove, in which the retainer is seated, preferably is substantially different from the initial unstressed shape of the resilient retainer such that a considerable deformation of the retainer occurs when under compression. This deformation increases the area of surface contact between the retainer and the tooth and tooth holder. Among the drawbacks of this design is that a substantial portion of the retainer extends between the two holes on the outside of tooth holder. Although a groove can be formed in the outside of the holder to seat this portion in a recess, this portion remains exposed to the environment. Such exposure can lead to reduced retainer life when the assembly is subjected to abrasive materials, for example.

SUMMARY OF THE INVENTION

The present invention is directed to an excavating tooth assembly having a locking mechanism that avoids the problems and disadvantages of the prior art. The invention accomplishes this goal by providing a tooth, tooth holder, and a resilient retaining member having a configuration that augments the area of surface contact between the resilient retainer and the surfaces between which it is compressed to more securely hold the tooth in a tooth holder.

The tooth holder has upper and lower members and a web extending therebetween. The tooth has a distal portion and a proximal portion which includes laterally spaced prongs. The prongs have inner walls bounded by upper and lower edges and are positioned in the tooth holder with inner walls facing toward the outer walls of the web. The resilient retaining member is elongated and has at least two ribs that extend substantially longitudinally along its outer surface. The resilient member is positioned between the inner and outer walls with one of the ribs engaging at least a portion of the upper edges of the prongs and another one of the ribs engaging at least a portion of the lower edges of the prongs. Thus, in addition to the frictional engagement between the resilient retainer and the inner and outer walls of the prongs and tooth holder, the ribs deform under compression and grip the edges of the prongs to increase the area of surface contact between the resilient retainer and the tooth prongs to more securely hold the tooth in its holder. Accordingly, the retaining member holds the tooth in the tooth holder despite extreme stresses tending to separate the parts when under load. On the other hand, the retainer will permit intentional dislodgment of the tooth in such a manner that it may be removed and sharpened, replaced, or otherwise repaired.

The gripping ribs are especially advantageous when the tooth edges are rounded, which is usually the case when the tooth is made either by casting or forging. In such case, the gripping ribs extend over the radius of the edge as the retainer is compressed to ensure that a sufficient area of the prong is engaged by the retaining member to lock the tooth in the tooth holder.

Another feature of the present invention is the provision of a plurality of longitudinally extending locating ribs on the retainer member. These ribs are equidistantly spaced from the ribs that engage the edges of the prongs and are positioned to contact the outer walls of the web. In this manner, the locating ribs can be used to orient the retainer relative to the web such that the other prong gripping ribs will be aligned with the upper and lower edges of the prongs.

The ribs also conform to the contour of the prong edges and web walls under compression. In this way, the ribs accommodate minor variations in the construction of the tooth and tooth holder, thereby making close tolerances of dimensions of the mating parts unnecessary. In a similar way, the rib arrangement accommodates wear of parts with passage of time.

Another aspect of the invention is that the resilient retainer is positioned deep inside the tooth holder where it is protected by the tooth and tooth holder from abrasive material in the environment.

It should be understood that although the present invention has particular application to earth augers, trenching machines, and the like, its securing strength permits it also to be used with larger earth-digging machinery such as graters, dippers, backhoes, harrows, scarifiers, cable plows, and similar equipment where the tooth is subject to heavier stresses than encountered in augers and trenching machines.

The above is a brief description of some deficiencies in the prior art and advantages of the present invention. Other features, advantages, and embodiments of the invention will be apparent to those skilled in the art from the following description, accompanying drawings, and appended claims.

DESCRIPTION OF THE PREFERRED EMBODIMENT

Figure 1:
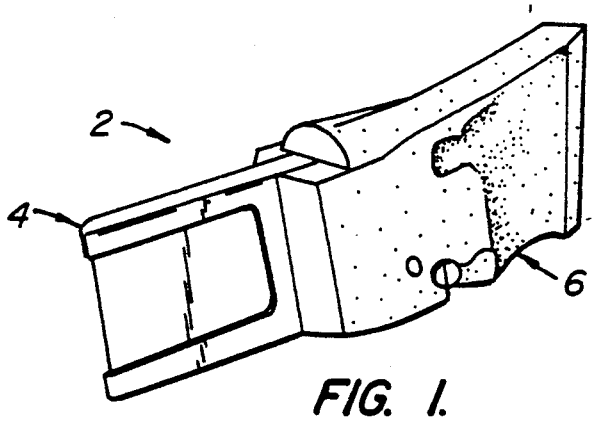
FIG. 1 is a perspective view of the excavating tooth assembly in accordance with the principles of the present invention.

Referring to the drawings in detail, wherein like numerals indicate like elements, the excavating tooth locking assembly 2 is illustrated in accordance with the principles of the present invention. Assembly 2 generally comprises tooth 4, tooth holder 6, and elongated resilient locking member 8.

Figure 2:
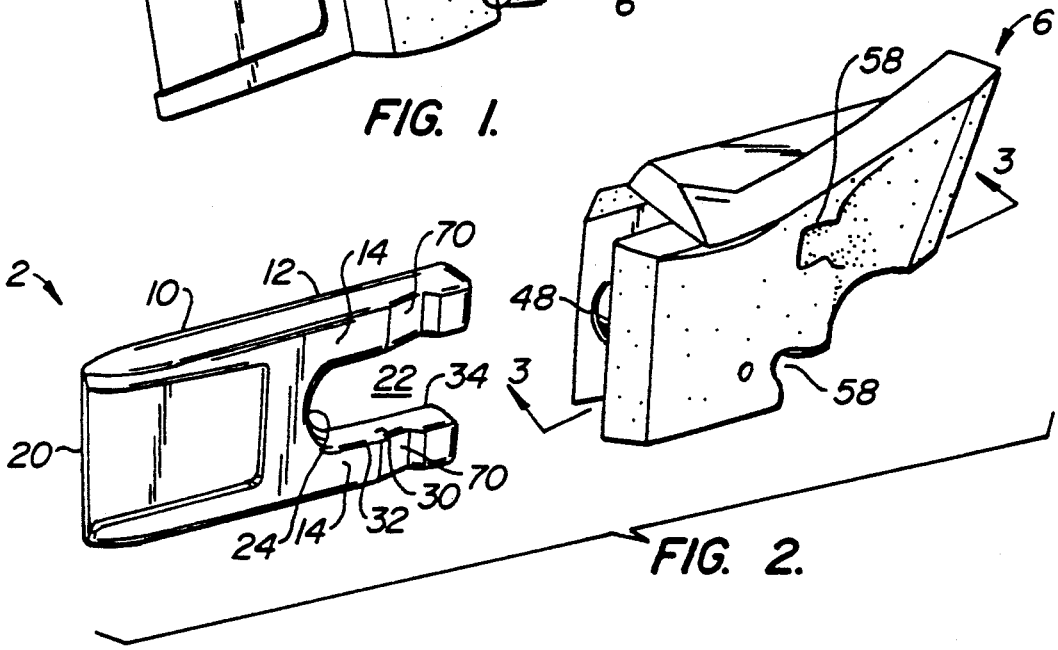
FIG. 2 is an exploded view of the tooth and tooth holder illustrated in FIG. 1.
Figure 5:
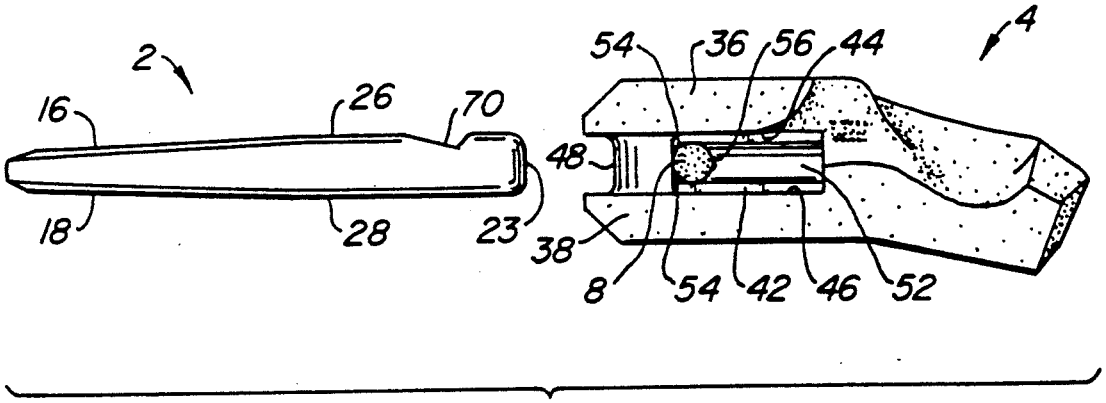
FIG. 5 is a side elevational view of the resilient locking member positioned in the tooth holder prior to insertion of the tooth.
Figure 6:
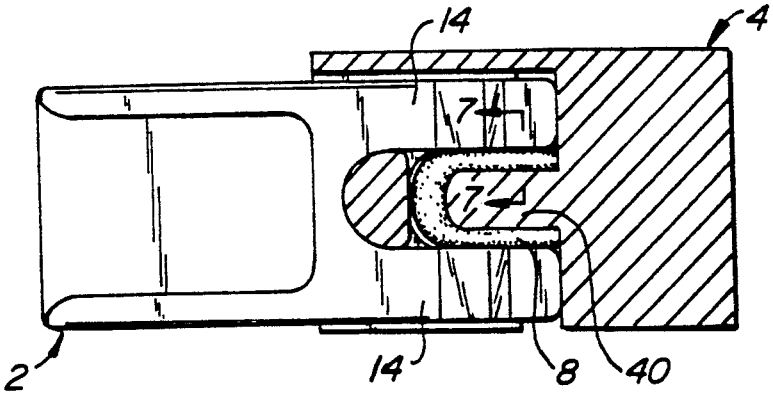
FIG. 6 is a partial sectional view of the assembly of FIG. 1 showing the resilient locking member of FIG. 4 compressed between the tooth and tooth holder.
Figure 7:
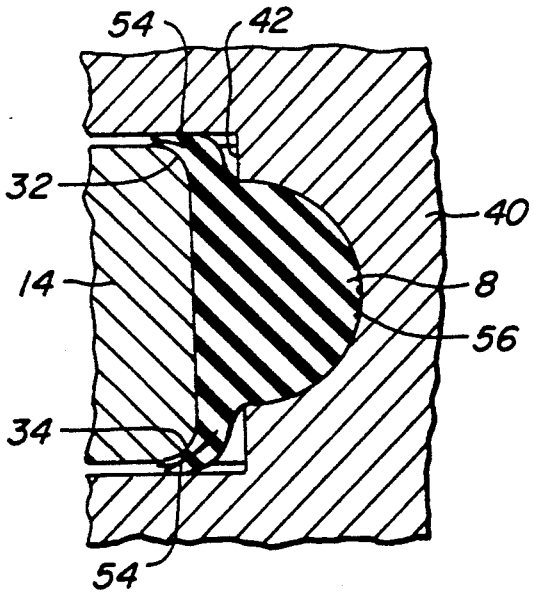
FIG. 7 is a sectional view of the locking mechanism taken along lines 7—7 in FIG. 6.

Referring to FIGS. 2, 5 and 6, tooth 4 includes a tapered distal portion 10 and a proximal portion 12 having two laterally spaced prongs 14. The distal position has downwardly and forwardly converging surfaces 16, 18 terminating in a digging or cutting end 20. Rearwardly of distal portion 10, prongs 14 are separated from each other by a slot 22 which extends forwardly from the proximal ends 23 of prongs 14 to a semicircular wall 24. Each prong has top and bottom surfaces 26, 28 which are preferably flat and parallel to each other but which may be slanted if desired. Prongs 14 further include inwardly facing vertical walls 30 which are bounded by upper and lower edges 32, 34. Edges 32, 34 are illustrated in FIG. 7 as being rounded. This is generally the case when the tooth is a cast or forged element, for example. However, the advantages of the resilient retainer construction described in more detail below also are apparent when edges are differently configured, e.g., more sharply cornered.

Figure 3:
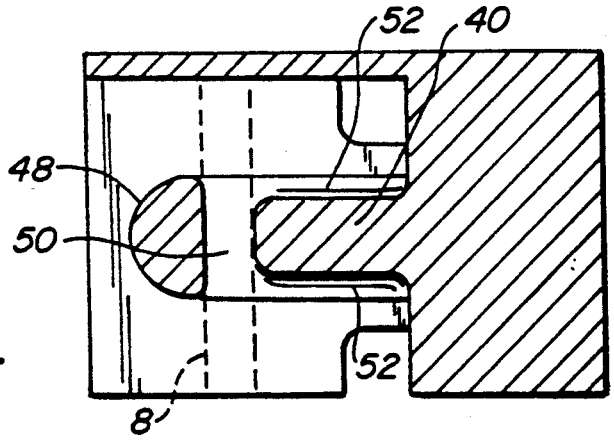
FIG. 3 is a sectional view of the tooth holder taken along lines 3—3 of FIG. 1.

Tooth holder 6 generally is fastened in any convenient way to a portion of the earth-digging equipment. Referring to FIGS. 3 and 5, the tooth holder is configured to receive and mate with tooth prongs 14. To that end, tooth holder 6 includes top and bottom flanges 36, 38 and a vertical web 40 extending therebetween. The cross-sectional shape of web 40 is such as to fit inside slot 22 with a slight clearance between the outer walls 42 of web 40 and the inner side walls 30 of prongs 14. Flanges 36, 38 include inner surfaces 44, 46 which are sufficiently spaced to accommodate the thickness of the prongs 14 of tooth 6. Surfaces 44, 46 also are sloped to accommodate the scope of prong surfaces 26, 28. Web 40 extends forwardly to a rounded end 48 that fits against the semicircular wall 24 of tooth 6 so that the rearward thrust of tooth 6 during the digging operation is transmitted to web end 48 and, thus, to the tooth holder 6.

Extending transversely through the web 40 is a hole 50 that receives resilient retainer 8. The length of retainer is substantially greater than the width of web 40 so that when tooth 6 is driven into position retainer 8 can bend back toward the outer walls 42 of web 40 and into longitudinal grooves 52 formed in walls 42. Grooves 52 are preferably semicircular in a cross-section and have a radius preferably substantially less than the radius of resilient retainer 8. In this way, considerable deformation of retainer 8 occurs when under compression to enhance the area of surface contact between the resilient retainer and the surfaces between which it is compressed (FIGS. 6 and 7).

Figure 4:
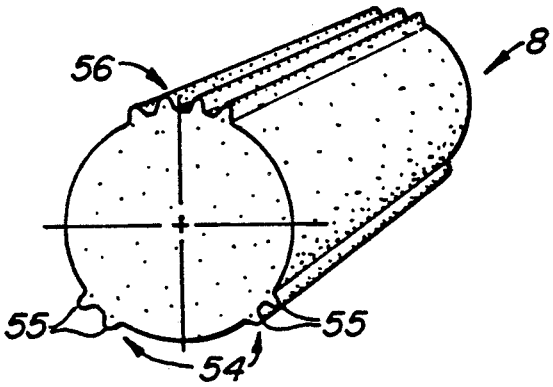
FIG. 4 is a perspective view of the resilient locking member in accordance with the principles of the present invention.

Referring to FIG. 4, resilient locking member 8 includes three groups or sets of ribs that extend longitudinally along its outer surface. Rib groups 54, which include gripping ribs 55, are circumferentially spaced such that when the resilient member is in position rib groups 54 overlap and engage upper and lower edges 32, 34 of tooth prongs 14. This prong gripping rib construction is especially advantageous when edges 32, 34 are curved or rounded, which typically results when the tooth is cast or forged, for example. The other group of ribs, rib group 56, serve as indicia for aligning the rib sets 54 such that they will engage upper and lower edges 32, 34 of prongs 14 when the tooth is forced into the tooth holder. In addition, deformation of rib group 56 when elongated retainer 8 is compressed allows the retainer to accommodate variances in the tooth holder dimensions, which typically exist when the tooth holder is formed by casting.

The method of attaching the tooth to the tooth holder will be described with reference to FIGS. 5–7. Retainer member 8 is inserted through transverse hole 50 in web 40. Rib group 56, which is readily distinguishable from rib group 54 due to its substantially greater number of ribs, is placed against the rearward surface of web hole 50. In this way, the other two groups of ribs are oriented and in alignment for receiving upper and lower edges 32, 34 of tooth prongs 14. The tooth is then inserted into the tooth holder and against retainer member 8 such that the retainer is forced rearward and seated in grooves 52 as rib groups 54 grip the edges of tooth prongs 14. Referring to FIG. 7, the locking mechanism is illustrated in cross-section with gripper ribs 55 of rib groups 54 extending over and gripping curved prong edges 32, 34. Specifically, when resilient member 8 is compressed between the tooth prongs and outer walls of web 40, it deforms to an extent such that ribs 55 are forced against the curved edges 32, 34 of tooth prongs 14. In this manner, the contact surface between the resilient retainer and the surfaces compressing the retainer is substantially increased such that the tooth is more securely held in the holder.

By reason of the above-described construction of retainer 8 and its cooperative engagement with the tooth and tooth holder, wear, vibration, the abrasive action of sand, gravel, or rocks in which the tool is digging, and the like, will not ordinarily cause separation of the tooth from the shank. However, when it is necessary to remove the tooth, for example, when it is desired to reverse or replace the tooth, a driving implement may be inserted through the back end of openings 58 and brought to bear against the rearward ends 23 of the tooth prongs. The tooth then may be driven forward until it is dislodged.

Although retainer member 8 is illustrated as having two ribs in each rib group 54 and four ribs in the rearward rib group 56, other combinations of ribs can be used without departing from the scope of the present invention. For example, it has been found that the desired results can be achieved when the forward rib groups each include three longitudinally extended ribs and the rearward rib group includes six to eight ribs. It is important that the rearward group can be readily distinguished and oriented against the rearward surface of web hole 50, as discussed above, to properly orient the other two sets of ribs. Accordingly, the rearward group preferably includes a noticeably greater number of ribs than the other forwardly positioned two groups. Alternatively, the ribs can be color coded, for example, to distinguish the forward and rearward groups for proper alignment in the hole 50. Combinations of the noticeably greater number of ribs with color coating also can be had without departing from the scope of the invention. It also is important that the forward rib sets are properly circumferentially spaced to ensure that they will surround the upper and lower edges of the prongs to grip and center prongs 14 in tooth holder 4. Generally, both forward sets of ribs should be essentially equidistant from the rearward set of ribs to ensure that the tooth is centered in the tooth holder recess.

Notches 70, which are configured to receive inserts or pegs as disclosed in U.S. Patent Nos. 2,968,880 (FIG. 7) (the disclosures of which is hereby incorporated herein), may be provided as auxiliary locking mechanisms.

Obviously, the sizes and materials used to make up an excavating tooth locking assembly in accordance with the present invention may be selected from a wide variety of sizes and/or materials. Merely to exemplify a preferred construction which has been found to produce the desired results the following example may be recited. Tooth prongs 14 have a thickness of about 0.4 inch. Web grooves 52 have a radius of about 0.125 inch for receiving a resilient retainer having a radius of about 0.250 inch. The longitudinal ribs extend radially about 0.005 inch when in an unstressed state. Adjacent ribs in a rib group are spaced about 15 degrees apart from peak-to-peak. The forward sets are circumferentially spaced about 90–120 degrees apart and preferably about 38 degrees apart. Retainer 8 may be formed of natural rubber elastomers such as neoprene and nitrile rubber, or other resilient material, such as nylon cord, latex dipped nylon cord, and soft iron wire, and is preferably nitrile rubber.

The above is a detailed description of a particular embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and the specifications should not be construed to unduly narrow the full scope of protection to which the invention is entitled.

What is claimed is:

1. An excavating tooth assembly comprising:

a tooth holder having upper and lower members and a web extending in a direction from the lower to upper member, said web having outer walls;

a tooth having a distal portion and a proximal portion, said proximal portion including laterally spaced prongs having inner walls bounded by upper and lower edges, said prongs being positioned in said tooth holder with said inner walls facing toward said outer walls of said web; and a resilient elongated member having at least two ribs that extend substantially longitudinally along the outer surface thereof, said resilient elongated member being compressed between said inner and outer walls with one of said ribs engaging at least a portion of said upper edges and another one of said ribs engaging at least a portion of said lower edges, thereby increasing the contact surface between the resilient member and the tooth and tooth holder.

2. The assembly of claim 1 wherein said elongated member includes two pairs of said ribs, one pair extending about a substantial portion of the upper edges of said prongs and the other pair extending about a substantial portion of the lower edges of said prongs.

4. The assembly of claim 1 wherein said elongated resilient member includes at least one longitudinally extending rib that engages at least a portion of the outer walls of said partition member.

4. The assembly of claim i wherein said elongated member includes at least one longitudinally extending rib that engages at least a portion of the outer walls of said partition member.

5. The assembly of claim 1 wherein said web includes a groove formed therein, at least a portion of said elongated member is seated in said groove.

6. The assembly of claim 1 wherein said outer walls are on opposite sides of said web, each outer wall including a longitudinally extending groove, a substantial portion of said elongated member being seated in said grooves.

7. The assembly of claim 6 wherein said web includes a hole extending transversely therethrough, said elongated member extending through said hole.

8. The assembly of claim 1 wherein said partition member includes a hole extending transversely therethrough, said elongated member extending through said

9. The assembly of claim 1 wherein the edges of said prongs are rounded.

10. An excavating tooth assembly comprising:

a tooth holder having channels formed therein;

a tooth having a distal portion and a proximal portion, said proximal portion including laterally spaced prongs having inner walls bounded by upper and lower edges, said prongs being positioned in said channels; and a resilient elongated member having a first and second group of ribs that extend substantially longitudinally along the outer surface of said elongated member, said elongated member being positioned between at least a portion of each prong and said tooth holder with said first group of ribs compressed against at least a portion of the upper edges of said prongs and said second group of ribs compressed against at least a portion of the lower edges of

11. The assembly of claim 10 wherein said tooth holder includes a wall between said channels, said wall having one surface facing one of said channels and a second surface facing the other one of said channels, each one of said surfaces including a groove, and said elongated member being seated in said grooves.

12. The assembly of claim 11 wherein said elongated member includes a third group of ribs that extend longitudinally along the outer surface of said member, said third group of ribs being positioned in said grooves and compressed against said wall surfaces.

13. The assembly of claim 12 wherein said wall includes a hole formed transversely therethrough and said elongated member extending through said hole.

14. A method of releasably securing an excavating tooth to a holder comprising the steps of:

providing a holder with a web having a transverse hole extending therethrough;

providing a resilient elongated member with first and second groups of longitudinally spaced ribs and indicia generally equidistantly spaced from said first and second groups;

inserting the resilient member in the holder with the indicia positioned against a rearward surface of the hole; and forcing a tooth having laterally spaced prongs about the web such that the resilient member is bent backward past the rearward surface of the hole with the rib groups engaging the upper and lower edges of the prongs.

* * * * *